US005120920A

United States Patent [19]

Moriike

[11] Patent Number: 5,120,920

[45] Date of Patent: Jun. 9, 1992

[54] KEY TOP

[75] Inventor: Tatsuya Moriike, Iwaki, Japan

[73] Assignee: Alps Electric Co., Ltd., Tokyo, Japan

[21] Appl. No.: 376,080

[22] Filed: Jul. 6, 1989

[30] Foreign Application Priority Data

Jul. 21, 1988 [JP] Japan ..... 63-180206

[51] Int. Cl.[5] ..... H01H 3/12; H01H 9/00

[52] U.S. Cl. ..... 200/341; 200/310; 200/313

[58] Field of Search ..... 200/314, 341, 313, 311, 200/310, 315, 316

[56] References Cited

U.S. PATENT DOCUMENTS 3,482,542 12/1969 Mace ..... 200/315 X
4,163,883 8/1979 Boulanger ..... 200/314
4,778,966 10/1988 Obata et al. ..... 200/314

FOREIGN PATENT DOCUMENTS 2803539 8/1979 Fed. Rep. of Germany ..... 200/314

*Primary Examiner*—Ernest G. Cusick
*Assistant Examiner*—David J. Walczak
*Attorney, Agent, or Firm*—Guy W. Shoup; B. Noel Kivlin; David W. Heid

[57] ABSTRACT

A key top includes an indicator member formed of a transparent or translucent synthetic resin and having a projection corresponding to a contour of an indicating portion, an outer member formed of an opaque synthetic resin and molded to cover an outer surface of the indicator member except a top surface of the projection, a light transmitting colored coating printed on the top surface of the projection, and a light shielding coating printed on a part of the light transmitting colored coating which corresponds to a closed portion of the indicating portion such as the center of the letter "O".

1 Claim, 5 Drawing Sheets

KEY TOP

BACKGROUND OF THE INVENTION

The present invention relates to a key top for a push button switch for use with an input device for a car stereo, car radio or the like, and more particularly to an illuminated key top having an indicating portion adapted to be illuminated.

A known illuminated key top having an indicating portion for indicating letters, symbols, etc. is manufactured by various methods.

For example, the key top is formed by a so-called bicolor molding method wherein an indicator member having the indicating portion is molded, and an outer member is then molded to cover the outer surface of the indicator member except a top surface of the indicating portion to be exposed.

FIG. 6 is a perspective view of the indicator member 1 to be formed by the bicolor molding method, and FIG. 7 is a perspective view of the key top 7 formed by using the indicator member 1 shown in FIG. 6 wherein the indicating portion 2 is illuminated.

Referring to FIG. 6, the indicator member 1 is molded from a transparent or translucent synthetic resin in such a manner as to integrally form a projection 2 as the indicating portion on the top surface of the indicator member 1. Then, as shown in FIG. 7, an outer member 6 is molded from an opaque synthetic resin so as to cover the outer surface of the indicator member 1 except a top surface of the indicating portion 1 to be exposed. Thus, the key top 7 is formed.

In the case that a closed portion 3 is so defined as to be surrounded by the indicating portion 2 as in the numerals "0" and "4", a horizontal groove 4 is formed by inserting a movable slide pin (not shown) for molding the indicator member 1 and then removing the slide pin after molding. Thus, the groove 4 is formed just under the closed portion 3. Then, the synthetic resin for the outer member 6 can fill the groove 4 and the closed portion 3 when molding the outer member 6.

Another method for forming the key top by a laser beam machining process is shown in FIGS. 8A to 8D. Referring first to FIG. 8A, the indicator member 1 is molded from a transparent or translucent synthetic resin. Then, as shown in FIG. 8B, a light transmitting colored coating 8 having a white color, for example, is applied onto an entire outer surface of the indicator member 1. Then, as shown in FIG. 8C, a light shielding colored coating 9 having a black color, for example, is deposited with a desired film thickness onto an entire outer surface of the light transmitting colored coating 8 by painting, sputtering or vapor deposition.

Furthermore, as shown in FIG. 8D, a laser beam 10 irradiates a top surface of the light shielding coating 9 in such a manner as to remove a part of the light shielding coating 9 which corresponds to the indicating portion 2. Thus, the light transmitting colored coating 8 is partially exposed at the indicating portion 2. Finally, a transparent hard coat (not shown) which acts as a protection layer is formed on the entire outer surface of the key top 7 by painting, sputtering or vapor deposition.

When the above-mentioned key top is formed by the bicolor molding method as shown in FIGS. 6 and 7, the synthetic resin for the outer member 6 having a light transmittance less than that of the indicating portion 2 fills the groove 4 under the indicating portion 2. Therefore, when the indicating portion 2 is illuminated from the inside of the key top 7, a portion 5 of the indicating portion 2 which is above the groove 4 filled with the opaque synthetic resin is shaded to cause nonuniformity illumination of the indicating portion 2. Furthermore, because the slide pin is used, the molded structure is complicated which increase the manufacturing cost.

On the other hand, in the key top to be formed by the laser beam machining as shown in FIGS. 8A to 8D, a laser device is used, and means for effecting painting, sputtering or vapor deposition are also used, thus increasing the manufacturing cost. Further, if the indicating portion 2 consists of plural letters or symbols, it is difficult to form the letters or symbols in different colors.

SUMMARY OF THE INVENTION

It is an object of the present invention to simplify the manufacturing steps for the key top and thereby reduce the manufacturing cost.

It is another object of the present invention to provide a key top which may ensure uniform illumination of the indicating portion.

It is a further object of the present invention to easily manufacture a multicolored indicating portion of the key top.

According to the present invention, there is provided a key top comprising an indicator member formed of a transparent or translucent synthetic resin and having a projection corresponding to a contour of an indicating portion, an outer member formed of an opaque synthetic resin and molded to cover an outer surface of said indicator member except a top surface of said projection, and a light transmitting colored coating printed on said top surface of said projection. In addition, a light shielding coating is printed on a part of said light transmitting colored coating which corresponds to a closed portion of said indicating portion such as the center of the numeral "0" and the enclosed portion of the numeral "4".

As mentioned above, the indicator member is formed of a transparent or translucent synthetic resin, and a projection is integrally formed on the top surface of the indicator member in such a manner as to correspond to a contour of an indicating portion to be formed on the top surface of the key top. The outer member is formed of an opaque synthetic resin, and is molded so as to cover the outer surface of the indicator member except the top surface of the projection. That is, only the top surface of the projection is exposed from the top surface of the outer member.

Furthermore, the light transmitting colored coating is formed by printing on the top surface of the projection. Furthermore, the light shielding coating is formed by printing on a part of the light transmitting colored coating which corresponds to a closed portion such as the center of the numeral "0" of the indicating portion.

With this construction, light is transmitted from an inner surface of the indicator member through the projection and the light transmitting colored coating but not through the part shielded by the light shielding coating. Therefore, in a bright environment, the indicating portion can be visually recognized by the color peculiar to the light transmitting colored coating as reflecting a natural light. In a dark environment such as in the night or in a tunnel or the like, the indicating portion is illuminated by an illuminating light transmitted from inside the indicator member through the light transmitting path as mentioned above. Accordingly, the indicating portion can be visually recognized by the color peculiar to the light transmitting colored coating as illuminated.

Other objects and features of the invention will be more fully understood from the following detailed description and appended claims when taken with the accompanying drawings.

DETAILED DESCRIPTION OF THE PREFERRED EMBODIMENTS

Figure 1:
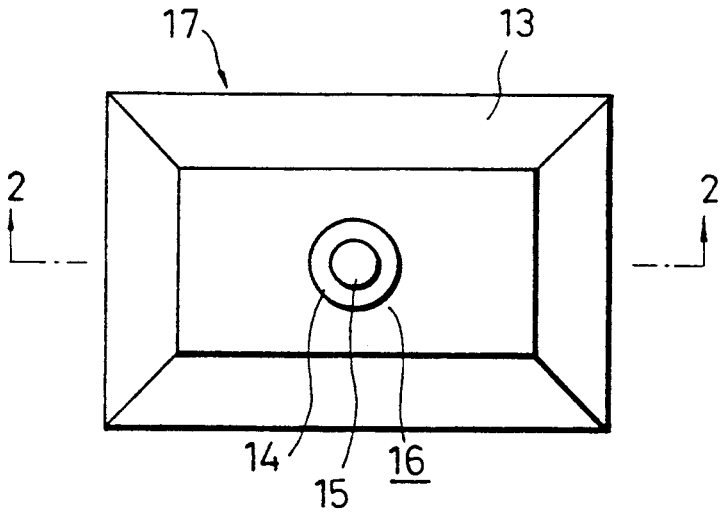
FIG. 1 is a plan view of a first preferred embodiment of the key top according to the present invention.

There will now be described a first preferred embodiment of the present invention with reference to FIGS. 1 to 3.

Referring first to FIGS. 3A to 3D, an indicator member 11 is molded from a transparent or translucent synthetic resin. Simultaneously, a projection 12 corresponding to a contour of an indicating portion is integrally formed on an upper surface of the indicator member 11 (see FIG. 3A). Then, an outer member 13 is molded from an opaque synthetic resin having a black color, for example, by the bicolor molding method in such a manner as to cover an outer surface of the indicator member 11 and allow only the top surface of the projection 12 to be exposed through the top surface of the outer member 13 (see FIG. 3B). Then, a light transmitting colored coating 14 having a white color, for example, is printed so as to entirely cover the exposed top surface of the projection 12 (see FIG. 3C). Then, a light shielding coating 15 having the same color (black) as the outer member 13 is printed on the light transmitting colored coating 14 at a position corresponding to a closed portion of the indicating portion such as the center of the letter "O" (see FIG. 3D). Then, a hard coat (not shown) is applied if required.

Figure 2:
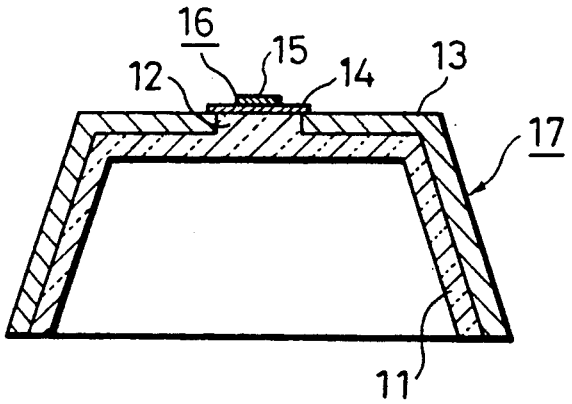
FIG. 2 is a cross section taken along the line 2—2 in FIG. 1.
Figure 3A:
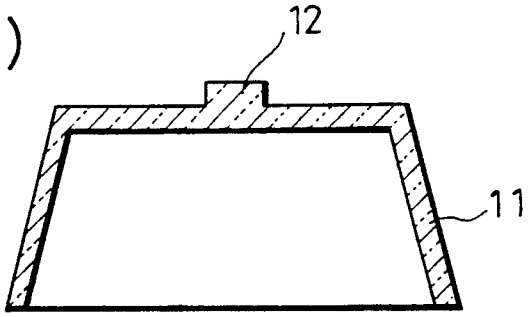
FIGS. 3A to 3D are sectional views illustrating the manufacturing steps of the key top.
Figure 3B:
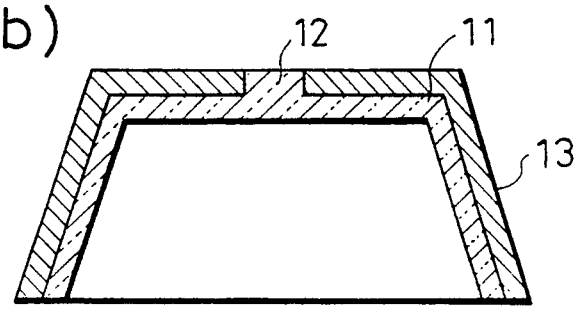
Figure 3C:
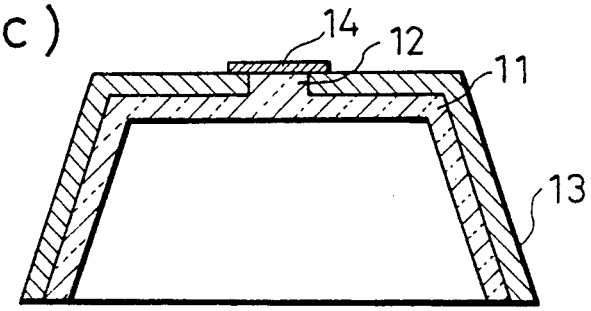
Figure 3D:
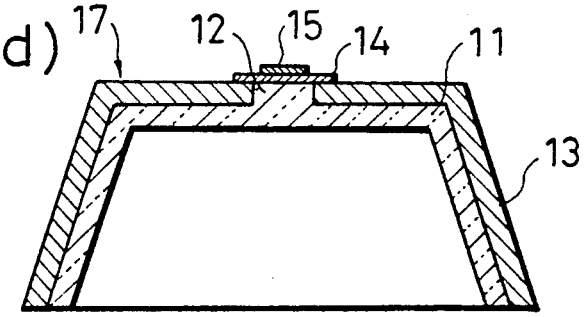

Thus, as shown in FIGS. 1 and 2, the indicating portion 16 is formed by the light transmitting colored (white) coating 14 and defined by the light shielding colored (black) coating 15 and the top surface of the black outer member 13. Reference numeral 17 generally designates a key top having the indicating portion 16 as formed above.

The key top 17 is formed with a light transmitting path extending from the inner surface of the indicator member 11 through the projection 12 and the light transmitting colored coating 14 except the light shielding coating 15 and the outer surface of the outer member 13. In case of adapting the key top 17 to a push button for an operation panel of a car stereo, for example, the indicating portion 16 indicating an alphabetic letter of "O" is visibly recognized on the black top surface of the key top 17 through the light transmitting colored (white) coating 14 centrally shielded by the light shielding black coating 15 in a bright environment such as in the daytime.

In a dark environment such as in the night or in a tunnel or the like, the indicating portion 16 is illuminated by a back light transmitted from inside the indicator member 11 through the afore-mentioned light transmitting path.

According to the first preferred embodiment as mentioned above, the key top 17 can be easily manufactured to thereby reduce the manufacturing cost because laser beam machining and painting, sputtering or vapor deposition are not employed at all. Further, the indicating portion 16 can be clearly and uniformly illuminated with no shading.

Figure 4:
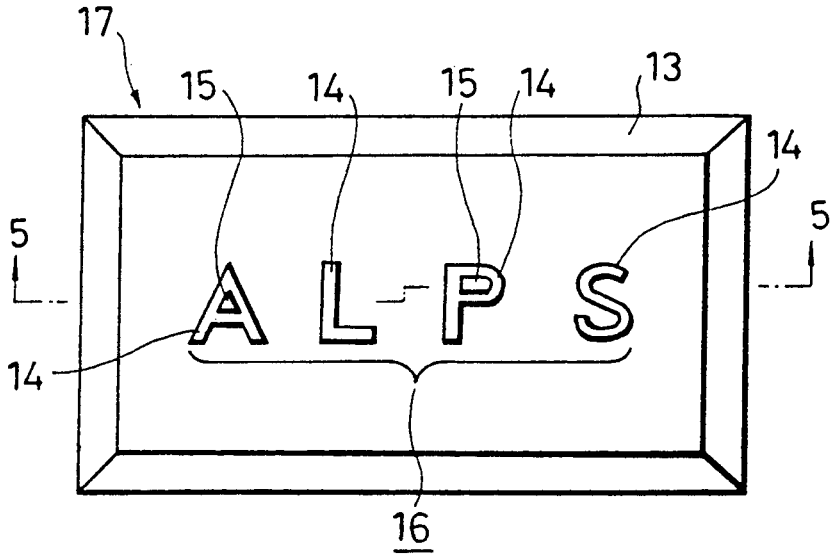
FIG. 4 is a plan view of a second preferred embodiment of the key top according to the present invention.
Figure 5:
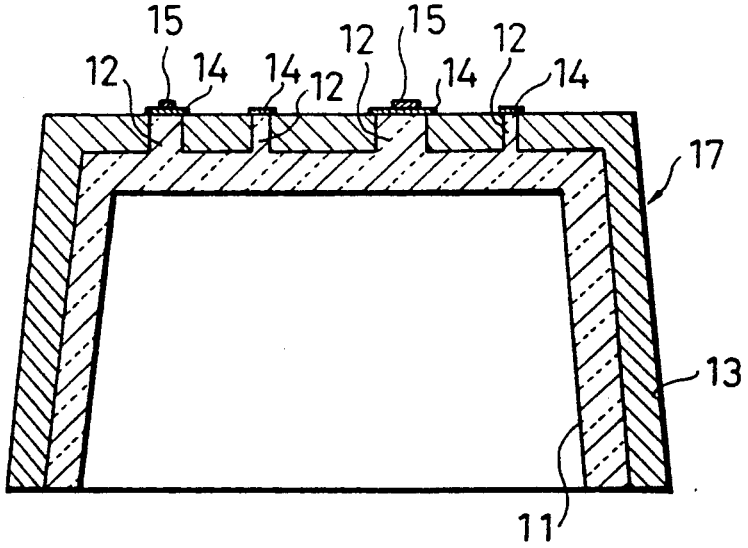
FIG. 5 is a cross section taken along the line 5—5 in FIG. 4.
Figure 6:
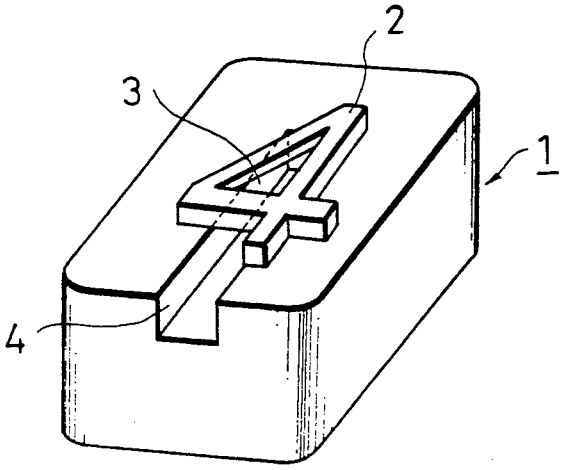
Prior Art Fig. 6
FIG. 6 is a perspective view of the indicator member in the prior art.
Figure 7:
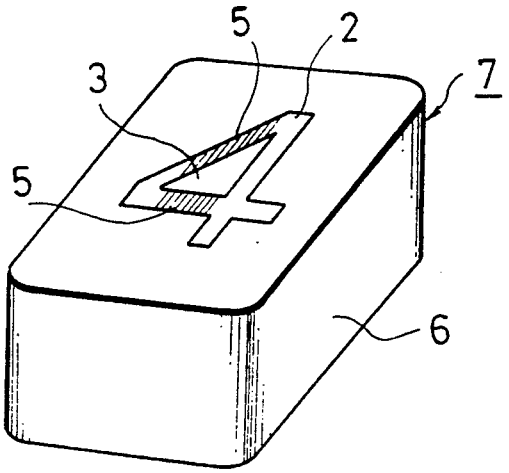
Prior Art Fig. 7
FIG. 7 is a perspective view of the key top formed by a bicolor molding method using the indicator member shown in FIG. 6.
Figure 8A:
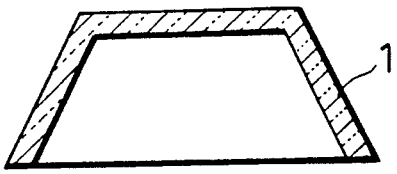
FIGS. 8A to 8D are sectional views illustrating the manufacturing steps of the key top by a laser beam machining in the prior art.
Figure 8B:
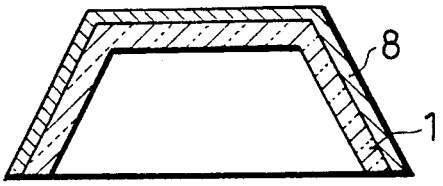
Figure 8C:
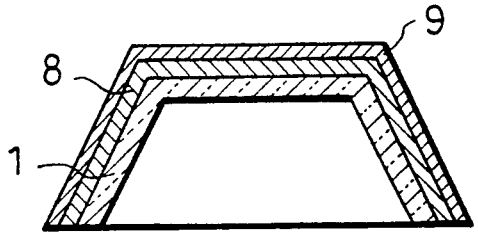
Figure 8D:
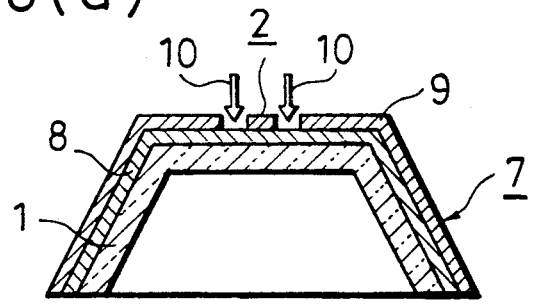

Referring next to FIGS. 4 and 5 which show a second preferred embodiment, the indicating portion 16 consists of a plurality of letters such as "ALPS" including the letters ("A" and "P") having a closed portion and the letters ("L" and "S") having no closed portion. In forming the indicating portion 16, four projections 12 corresponding to the contours of the respective letters are integrally formed on the top surface of the indicator member 11 when molding the indicator member 11 from a transparent or translucent synthetic resin. Similar to the first preferred embodiment, the opaque outer member 13 is then molded by the bicolor molding method to cover the outer surface of the indicator member 11 in such a manner as to expose only the top surfaces of the projections 12 through the top surface of the outer member 13. Then, the light transmitting colored coatings 14 having a desired color are printed so as to cover the top surfaces of the projections 12. Then, the light shielding coatings 15 having the same color as the outer member 13 are printed on the light transmitting colored coatings 14 at the closed portions of the letters "A" and "P". Thereafter, a hard coat is applied if required.

In the second preferred embodiment, by using different colors for the light transmitting colored coatings 14 and plurality of printing screens in printing the light transmitting colored coatings 14 onto the top surfaces of the projections 12, the plurality of letters constituting the indicating portion 16 can be easily made multicolored. While the indicating operation of the second preferred embodiment is similar to that of the first preferred embodiment, the multicoloring of the indicating portion 16 can improve visual recognition.

According to the second preferred embodiment, the manufacturing step of the indicating portion 16 can be simplified to thereby reduce the manufacturing cost in the same manner as the first preferred embodiment. Further, the indicating portion 16 can be clearly and uniformly illuminated with no shading. Additionally, the multicoloring of the indicating portion 16 can be easily carried out by changing printing color.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A key top including an area to be illuminated, said key top comprising:

an indicator member formed of a light transmitting synthetic resin and having an outer surface;

an indicating portion formed as a projection of said indicator member and having a top surface, wherein an outer contour of said projection corresponds to an outer periphery of said area to be illuminated;

an outer member formed of an opaque synthetic resin and molded to cover a portion of the outer surface of said indicator member, wherein said outer member does not cover the top surface of said indicating portion;

a light transmitting colored coating applied to said top surface of said indicating portion; and a light shielding coating applied to a portion of said light transmitting colored coating, said portion of said light transmitting colored coating corresponding to a closed non-illuminated portion having a circumferential boundary that is surrounded by said area to be illuminated.

* * * * *